US006609382B2

(12) United States Patent
Vander Woude et al.

(10) Patent No.: US 6,609,382 B2
(45) Date of Patent: Aug. 26, 2003

(54) CONTROL METHOD FOR A SELF-POWERED CRYOGEN BASED REFRIGERATION SYSTEM

(75) Inventors: David J. Vander Woude, Farmington, MN (US); Herman H. Viegas, Bloomington, MN (US); Jayaram Seshadri, Minneapolis, MN (US); Joseph Louis Glentz, Winona, MN (US); Bryan Edward Schwichtenberg, East Troy, WI (US); William Ehrich Stuart, Winona, MN (US)

(73) Assignee: Thermo King Corporation, Minneapolis, MI (US)

( * ) Notice: Subject to any disclaimer, the term of this patent is extended or adjusted under 35 U.S.C. 154(b) by 0 days.

(21) Appl. No.: 10/162,436

(22) Filed: Jun. 4, 2002

(65) Prior Publication Data

US 2003/0019224 A1 Jan. 30, 2003

Related U.S. Application Data

(60) Provisional application No. 60/295,708, filed on Jun. 4, 2001.

(51) Int. Cl.[7] ..... F17C 9/02; F25B 41/04; F25D 21/06

(52) U.S. Cl. ..... 62/50.2; 62/223; 62/155

(58) Field of Search ..... 62/186, 50.2, 216, 62/223, 155; 165/64

(56) References Cited

U.S. PATENT DOCUMENTS

| | | | |
|---|---|---|---|
| 2,535,364 | A | 12/1950 | Lee |
| 2,720,084 | A | 10/1955 | Hailey |
| 3,058,317 | A | 10/1962 | Putman |
| 3,121,999 | A | 2/1964 | Kasbohm et al. |
| 3,159,982 | A | 12/1964 | Schachner |
| 3,307,366 | A | 3/1967 | Smith |
| 3,314,007 | A | 4/1967 | Johnson |
| 3,421,336 | A | 1/1969 | Lichtenberger et al. |
| 3,507,128 | A | 4/1970 | Murphy et al. |
| 3,552,134 | A | 1/1971 | Arenson |

(List continued on next page.)

FOREIGN PATENT DOCUMENTS

| | | |
|---|---|---|
| FR | 2217646 | 2/1973 |

OTHER PUBLICATIONS

SB–III CR Fact Sheet; Thermo King Corporation, Dec. 10, 1996.

SB–III CR Unit, Customer Site Requirements; Automatic Filling Station, Thermo King Corporation, Dec. 10, 1996.

SB–III CR Unit: Refueling Requirements, Thermo King Corporation, Dec. 10, 1996.

SB–III CR Features; Thermo King Corporation, Jan. 22, 1997.

Thermoguard P–CR Microprocessor Control System Revision 450 x Software TK51262–2–OD (Rev. 1, 06–01), Diagnostic Manual, Copyright 2001—Thermo King Corp.—Minneapolis, MN.

(List continued on next page.)

*Primary Examiner*—William C. Doerrler
(74) *Attorney, Agent, or Firm*—Michael Best & Friedrich LLP

(57) ABSTRACT

A method of temperature control in a cryogenic system, wherein the system includes a cryogenic tank. The method comprises providing a motor speed sensor which determines a motor speed, providing a pressure sensor which determines a cryogenic pressure, providing a temperature sensor in the conditioned space which measures a temperature within the conditioned space, providing a deprived integral region, and generating an overriding control signal at the proportional-integral-derivative controller when the temperature and the pressure are beyond a temperature set point and a pressure set point.

28 Claims, 8 Drawing Sheets

U.S. PATENT DOCUMENTS 3,621,673 A 11/1971 Foust
3,693,370 A 9/1972 Miller
3,694,750 A 9/1972 Schuhrke
3,712,073 A 1/1973 Arenson
3,727,423 A 4/1973 Nielson
3,740,961 A 6/1973 Fischer
3,788,091 A 1/1974 Miller
3,802,212 A 4/1974 Martin et al.
3,823,568 A 7/1974 Bijasiewicz et al.
3,891,925 A 6/1975 Dimeff
3,990,816 A 11/1976 Kohler et al.
4,045,972 A 9/1977 Tyree, Jr.
4,050,972 A 9/1977 Cardinal, Jr.
4,060,400 A 11/1977 Williams
4,082,968 A 4/1978 Jones
4,100,759 A 7/1978 Tyree, Jr.
4,165,618 A 8/1979 Tyree, Jr.
4,171,495 A 10/1979 McNinch, Jr.
4,186,562 A 2/1980 Tyree, Jr.
4,201,191 A 5/1980 Zink et al.
4,211,085 A 7/1980 Tyree, Jr.
4,224,801 A 9/1980 Tyree, Jr.
4,233,817 A 11/1980 Toth
4,321,796 A 3/1982 Kohno
4,333,318 A 6/1982 Tyree, Jr.
4,334,291 A 6/1982 Tyree, Jr. et al.
4,348,873 A 9/1982 Yamauchi et al.
4,350,027 A 9/1982 Tyree, Jr.
4,356,707 A 11/1982 Tyree, Jr. et al.
4,406,129 A 9/1983 Mills
4,439,721 A 3/1984 Mura
4,441,326 A 4/1984 Bernauer et al.
4,498,306 A 2/1985 Tyree, Jr.
4,543,793 A 10/1985 Chellis et al.
4,576,010 A 3/1986 Windecker
4,606,198 A 8/1986 Latshaw et al.
4,608,830 A 9/1986 Peschka
4,626,781 A 12/1986 Forkel
4,688,390 A 8/1987 Sawyer
4,693,737 A 9/1987 Tyree, Jr.
4,695,302 A 9/1987 Tyree, Jr.
4,706,468 A 11/1987 Howland et al.
4,739,623 A 4/1988 Tyree, Jr. et al.
4,748,818 A 6/1988 Satterness et al.
4,783,972 A 11/1988 Tyree, Jr. et al.
4,800,728 A * 1/1989 Klee ..... 62/63
4,856,285 A 8/1989 Acharya et al.
4,858,445 A 8/1989 Rasovich
4,878,362 A 11/1989 Tyree, Jr.
4,888,955 A 12/1989 Tyree, Jr. et al.
4,903,495 A 2/1990 Howland et al.
4,937,522 A 6/1990 Gee
4,940,937 A 7/1990 Hattori et al.
4,941,527 A 7/1990 Toth et al.
4,995,234 A 2/1991 Kooy et al.
5,029,288 A 7/1991 Kubota et al.
5,040,374 A 8/1991 Micheau
5,056,324 A 10/1991 Haley
5,056,991 A 10/1991 Peschka et al.
5,069,039 A 12/1991 Martin
5,090,209 A 2/1992 Martin
5,095,709 A 3/1992 Billiot
5,124,602 A 6/1992 Nishimura et al.
5,127,230 A 7/1992 Neeser et al.
5,147,005 A 9/1992 Haeggstrom
5,170,631 A 12/1992 Lang et al.
5,172,559 A 12/1992 Renken et al.
5,199,275 A 4/1993 Martin
5,203,179 A 4/1993 Powell
5,209,072 A 5/1993 Truckenbrod et al.
5,243,821 A 9/1993 Schuck et al.
5,259,198 A 11/1993 Viegas et al.
5,267,443 A 12/1993 Roehrich et al.
5,267,446 A 12/1993 Viegas et al.
5,285,644 A * 2/1994 Roehrich et al. ..... 62/50.3
5,287,705 A 2/1994 Roehrich et al.
D345,009 S 3/1994 Lewis et al.
5,291,130 A 3/1994 Kendzior
5,293,748 A 3/1994 Flanigan
5,305,825 A * 4/1994 Roehrich et al. ..... 165/64
5,311,927 A 5/1994 Taylor et al.
5,313,787 A 5/1994 Martin
5,315,840 A 5/1994 Viegas et al.
5,317,874 A 6/1994 Penswick et al.
5,320,167 A 6/1994 Roehrich et al.
5,333,460 A 8/1994 Lewis et al.
5,365,744 A 11/1994 Viegas et al.
5,396,777 A 3/1995 Martin
5,410,886 A 5/1995 Wallace et al.
5,410,890 A 5/1995 Arima
5,458,188 A * 10/1995 Roehrich et al. ..... 165/64
5,477,690 A 12/1995 Gram
5,511,955 A 4/1996 Brown et al.
5,533,340 A 7/1996 Shama et al.
5,557,938 A 9/1996 Hanson et al.
5,561,986 A 10/1996 Goodall
5,564,277 A 10/1996 Martin
5,598,709 A 2/1997 Viegas et al.
5,605,049 A * 2/1997 Moore et al. ..... 62/63
5,606,870 A 3/1997 Lester
5,669,223 A 9/1997 Haley et al.
5,694,776 A 12/1997 Sahm
5,699,670 A 12/1997 Jurewicz et al.
5,711,161 A 1/1998 Gustafson
5,730,216 A 3/1998 Viegas et al.
5,775,110 A 7/1998 Waldron
5,819,544 A 10/1998 Andonian
5,870,897 A 2/1999 Barr et al.
5,908,069 A 6/1999 Baldwin et al.
5,916,246 A 6/1999 Viegas et al.
5,921,090 A * 7/1999 Jurewicz et al. ..... 62/50.2
5,947,712 A 9/1999 Viegas et al.
5,979,173 A 11/1999 Tyree
5,996,472 A 12/1999 Nguyen et al.
6,006,525 A 12/1999 Tyree, Jr.
6,038,868 A 3/2000 Pooley et al.
6,062,030 A 5/2000 Viegas
6,076,360 A 6/2000 Viegas et al.
6,086,347 A 7/2000 Ryska et al.
6,095,427 A 8/2000 Hoium et al.
6,106,255 A 8/2000 Viegas et al.
6,202,671 B1 3/2001 Horstmann
6,220,048 B1 4/2001 Finan, Sr. et al.
6,276,142 B1 8/2001 Putz

OTHER PUBLICATIONS

SB–III CR Proof Copy TK51293–X.X, Copyright 2001—Thermo King Corp.—Minneapolis, MN, Dated Nov. 28, 2001.

SB–III CR TK 51309–2–OP (Rev. 07/01), Copyright 2001—Thermo King Corp.—Minneapolis, MN.

Liquid Carbon Dioxide Transport Refrigeration System; Herman Viegas, Thermo King Corporation, 314 West 90$^{th}$ Street, Minneapolis, Minnesota USA 55420, Presented at The Seventh CRYOGENICS 2002 IIR International Conference in Prague, Czech Republic, Apr. 23–26, 2002.

* cited by examiner

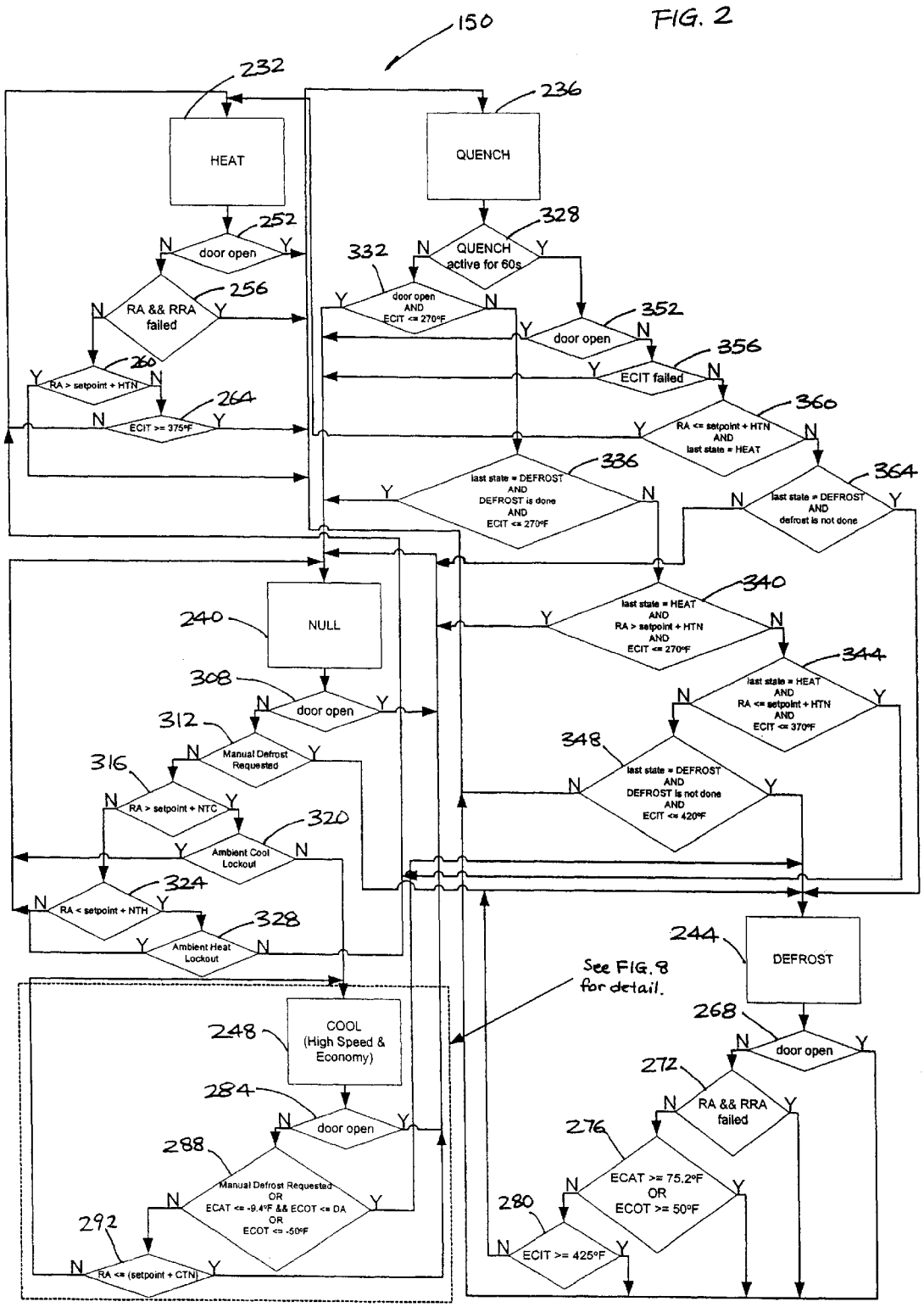
FIG. 2
150
232
HEAT
236
QUENCH
252
door open
256
RA && RRA failed
260
RA > setpoint + HTN
264
ECIT >= 375°F
328
QUENCH active for 60s
332
door open AND ECIT <= 270°F
352
door open
356
ECIT failed
360
RA <= setpoint + HTN AND last state = HEAT
336
last state = DEFROST AND DEFROST is done AND ECIT <= 270°F
364
last state = DEFROST AND defrost is not done
240
NULL
340
last state = HEAT AND RA > setpoint + HTN AND ECIT <= 270°F
344
last state = HEAT AND RA <= setpoint + HTN AND ECIT <= 370°F
308
door open
312
Manual Defrost Requested
316
RA > setpoint + NTC
320
Ambient Cool Lockout
348
last state = DEFROST AND DEFROST is not done AND ECIT <= 420°F
324
RA < setpoint + NTH
328
Ambient Heat Lockout
244
DEFROST
See FIG. 8 for detail.
248
COOL (High Speed & Economy)
268
door open
272
RA && RRA failed
284
door open
276
ECAT >= 75.2°F OR ECOT >= 50°F
288
Manual Defrost Requested OR ECAT <= -9.4°F && ECOT <= DA OR ECOT <= -50°F
280
ECIT >= 425°F
292
RA <= (setpoint + CTN)

228

| | | | | | | | | | |
|---|---|---|---|---|---|---|---|---|---|
| 1 | -69.829 | 6 | -48 | 11 | -38 | 16 | -28 | 21 | -18 |
| 2 | -65 | 7 | -46 | 12 | -36 | 17 | -26 | 22 | -16 |
| 3 | -60 | 8 | -44 | 13 | -34 | 18 | -24 | 23 | -14 |
| 4 | -55 | 9 | -42 | 14 | -32 | 19 | -22 | 24 | -12 |
| 5 | -50 | 10 | -40 | 15 | -30 | 20 | -20 | 25 | -10 |

| | | | | | | | | | |
|---|---|---|---|---|---|---|---|---|---|
| 1 | 75.138 – 14.7 | 6 | 123.34 – 14.7 | 11 | 151.82 – 14.7 | 16 | 184.90 – 14.7 | 21 | 223.02 – 14.7 |
| 2 | 84.296 – 14.7 | 7 | 128.69 – 14.7 | 12 | 158.06 – 14.7 | 17 | 192.11 – 14.7 | 22 | 231.29 – 14.7 |
| 3 | 94.643 – 14.7 | 8 | 134.21 – 14.7 | 13 | 164.48 – 14.7 | 18 | 199.52 – 14.7 | 23 | 239.78 – 14.7 |
| 4 | 105.91 – 14.7 | 9 | 139.90 – 14.7 | 14 | 171.09 – 14.7 | 19 | 207.14 – 14.7 | 24 | 248.49 – 14.7 |
| 5 | 118.16 – 14.7 | 10 | 145.77 – 14.7 | 15 | 177.90 – 14.7 | 20 | 214.97 – 14.7 | 25 | 257.44 – 14.7 |

224

FIG. 7

CONTROL METHOD FOR A SELF-POWERED CRYOGEN BASED REFRIGERATION SYSTEM

CROSS REFERENCE TO RELATED APPLICATIONS

This application claims priority under 35 U.S.C. §119 to provisional patent application Ser. No. 60/295,708, filed on Jun. 4, 2001.

BACKGROUND OF THE INVENTION

This invention relates generally to air conditioning and refrigeration systems and more specifically to cryogenic refrigeration systems.

In previous cryogen based refrigeration systems, a controller using a fuzzy logic scheme controlled the system. While the fuzzy logic scheme is well suited to controlling a cryogen system, it takes a substantial amount of time to generate a prediction of the required motor speed. The prediction time that is required by the fuzzy logic system often allows the motor speed to oscillate. On occasion, the motor speed may oscillate between 1400 revolutions-per-minute ("RPM") and 1600 RPM, thus bringing the temperature of the conditioned space to an undesired range, and consequently damaging the load. The oscillation may sometimes even cause instability of the system. Furthermore, cryogen systems often have several modes of operation such as Cool, Heat, or Defrost, and also user-programmable control is preferred. However, the current fuzzy logic controllers evaluate system sensors to determine which mode to implement with little or no user input. Therefore, a user-programmable control system that regulates the motor speed in a manageable fashion would be welcomed by users of such systems.

SUMMARY OF THE INVENTION

According to the present invention, a method of temperature control in a cryogenic system, wherein the system includes a cryogen tank, and wherein the cryogen tank contains a cryogen, includes providing a motor speed sensor, the motor speed sensor being operatively coupled to a proportional-integral-derivative controller, the motor speed sensor determining a motor speed and sending the motor speed to the proportional-integral-derivative controller, providing a pressure sensor in the cryogen, the pressure sensor being operatively coupled to the proportional-integral-derivative controller, the pressure sensor determining a pressure at an end of an evaporator coil, and sending the pressure to the proportional-integral-derivative controller, providing a temperature sensor in the conditioned space, the temperature sensor being operatively coupled to the proportional-integral-derivative controller, the temperature sensor measuring a temperature within the conditioned space and sending the temperature to the proportional-integral-derivative controller, providing a deprived integral region in a proportional band to the proportional-integral-derivative controller when the motor speed is close to a motor speed set point, and generating an overriding control signal at the proportional-integral-derivative controller when the temperature and the pressure are beyond a temperature set point and a pressure set point.

In another aspect of the invention, a method of controlling a cryogenic temperature system, wherein the cryogenic system uses a proportional-integral-derivative control, controls the temperature within a conditioned space, and includes a cryogenic tank, includes determining a motor speed, determining a pressure of a cryogen, determining a plurality of temperatures inside the conditioned space, determining a plurality of temperatures out side the conditioned space, determining a new motor speed based on the motor speed, the pressure, the temperatures, and a plurality of predetermined temperature and pressure tables, and actuating the motor based on the new motor speed.

In yet another aspect of the present invention, a method of conserving a heat absorbing liquid in a cryogenic temperature control system, wherein the system includes a controller and a motor, and wherein the controller adjusts a motor speed, includes setting a target motor speed, averaging the motor speed over a predetermined amount of time after the system has entered a temperature controlling mode, regulating the heat absorbing liquid after the predetermined amount of time, resetting the target motor speed to a new target motor speed if the average motor speed is less than or equal to a predetermined speed below the target motor speed, the new target motor speed being set below the average motor speed by a predetermined motor speed value, and adjusting the motor speed such that the motor speed approaches the new target motor speed for a second predetermined amount of time.

In still another aspect of the present invention, a cryogenic temperature control system includes a conditioned space containing a gas and a load, the gas having a gas heat and thereby also having a temperature, a heat exchanger in the conditioned space, the heat exchanger having a heat absorbing liquid, and the heat absorbing liquid absorbing the gas heat within the conditioned space thereby lowering the temperature within the conditioned space, a heat source, the heat source releasing heat into the conditioned space thereby increasing the temperature within the conditioned space, a fan adjacent to the heat source and the heat exchanger, the fan circulating the gas in the conditioned space thereby having a fan speed, a temperature sensor determining a temperature within the conditioned space, a pressure sensor determining a cryogenic pressure at an end of an evaporator coil, and a controller operatively coupled to the fan, the temperature sensor, the pressure sensor, the heat exchanger, and the heat source, the controller receiving the temperature from the temperature sensor, receiving the pressure from the pressure sensor, adjusting the fan speed within the proportional band based on the temperature, the pressure, and the fan speed.

The controller of the present invention uses a proportional-integral-derivative ("PID") approach coupled with a "wrapper" program. The wrapper program evaluates the status of the refrigeration system, the environmental conditions, and user inputs to determine how the system should operate and in which mode the system should operate. This allows the user to quickly and easily override the program if desired. For example, a system installed on a truck may require quiet operation when passing through residential neighborhoods. The vapor motor fan is likely the largest producer of noise. A classical system using fuzzy logic would determine the fan speed based on the needs of the system. In the present invention, the user can set a lower vapor motor speed to provide quiet operation, and the system will compensate by adjusting other parameters such as cryogen flow.

A cryogen system controllable by the present method includes a micro-processor based controller, a cryogen tank for storage of liquid cryogen, a heat exchanger or evaporator, a heat exchanger fan driven by a vapor motor, a second heat exchanger for heating cryogen, and a heat source. In addition, a system uses valves and sensors throughout the system to control the flow of the cryogen and to monitor system parameters such as temperature at various points within the system and the $CO_2$ pressure. Cryogen refrigeration systems generally use carbon dioxide ("$CO_2$") or nitrogen ("$N_2$") as the cryogenic fluid, however other fluids can be used.

The control method of the present system allows for the use of a cryogen based refrigeration system in one of several modes. These modes include 1) Heat, 2) Defrost, 3) Cool, 4) Null, and 5) Quench. While these active modes are included in the proposed method, the addition of other modes is contemplated by the present invention. Each of these modes except Null mode uses a PID (Proportional, Integral, Derivative) control method to control the fan speed within the system. In addition to these modes, the system includes several protection algorithms. These protection algorithms include 1) two ambient lockouts, 2) Top Freeze Protection, 3) Superheat Protection, and 4) $CO_2$ Saver. While these algorithms are included in the contemplated system, the system is in no way limited to these alone.

To determine which mode the cryogen refrigeration system should be operating in at any given instant, a wrapper program or State Machine Program ("SMP") is utilized. The SMP checks the ambient lockout status, and performs special functions for timer and flag initialization. The checks are performed based on the current state of the system, the previous state, and the anticipated future state of the system. If no ambient lockout exists and all special functions, timers, and flags are clear, the SMP chooses one of the five active modes contemplated at present in which the system can operate.

To understand the function performed by the SMP, a brief explanation of the different modes and lockouts is necessary. The system uses two ambient lockouts, a Heat Lockout and a Cool Lockout. Ambient lockouts are used to conserve cryogen. The Heat Lockout prevents the system from running in Heat mode when there is a call for heat and the ambient air temperature is above a preset value. The use of warm ambient air to provide the necessary heat rather than heating the cryogen or the return air from the cooled space reduces cryogen use. The Cold Lockout operates in a similar manner. When cooling is required and the ambient air temperature is below a preset value, ambient air is used to cool the cooled space rather than cryogen. If a lockout is present, the system cannot enter the corresponding Heat or Cool mode. The unit will remain in a Null mode.

Top Freeze Protection is initiated when the desired temperature within the cooled area is set to 32° F. or higher. When the desired temperature is above 32° F. the system under certain circumstances will admit cooling air that is colder than 32° F. This cold air, falling on the cooled goods, can cause freezing of the outside portions of the goods. This is an undesirable effect. If the conditions that cause top freeze are present, the system will disengage the active control of the temperature and enter Top Freeze Protection. In Top Freeze Protection, the expansion valve is closed to reduce the cooling capacity of the system and prevent the discharge air from cooling to a temperature below 32° F. The discharge air flows into the cooled space to provide cooling.

Superheat protection is used to minimize the possibility of flooding the vapor motor with liquid cryogen. The SMP monitors the evaporator coil conditions to assure that a preset amount of superheat exists within the cryogen vapor. When enough superheat does not exist, the SMP will engage Superheat Protection and disengage active temperature control. To determine the amount of superheat present, evaporator temperatures and pressures are measured. In one embodiment, the amount of superheat is calculated by comparing the evaporator coil temperature to the saturation temperature of the cryogen at the pressure measured at the outlet of the evaporator coil. This calculation uses several temperature and pressure sensors in conjunction with a known calculation to determine the amount of superheat. If the amount is below a preset and user adjustable value, the expansion valve is closed a preset percentage—in the preferred embodiment, 10%. The process is repeated periodically until the amount of superheat is acceptable or the valve reaches a certain preset position—in the preferred embodiment, 30% open. In addition to monitoring the degree of superheat, the system monitors the condition of the sensors. Should one of the necessary sensors fail, the system is programmed to use alternative sensors or to switch into certain protective modes. For example, should the evaporator coil average temperature sensor fail, the system automatically switches into Superheat Protection mode to protect the vapor motor from potential damage. Many other methods are possible for calculating superheat, thus allowing the use of many different sensor arrangements.

$CO_2$ Saver functions as an optimizer to the PID control algorithm. $CO_2$ Saver is initiated when the system has been in a temperature controlling state for a predetermined period of time, but has been unable to reach the desired fan set point speed. Cryogen pressure is used to drive the vapor motor. Eventually, the cryogen tank will empty to a point at which the cryogen will not be capable of generating the pressure necessary to drive the vapor motor at the desired speed. The PID controller, in an effort to reach the fan speed set point, will force the valve to its full open position, wasting cryogen while still not achieving the desired speed. Under these conditions, the $CO_2$ Saver will reduce the fan speed set point by a pre-selected value and allow the system to settle. If the fan speed is still below the set point speed, the process will be repeated. The fan speed set point will again be reduced and the system allowed to settle. The process will continue until the fan speed is approximately equal to the fan speed set point and the PID controller is controlling the system. This also happens when the unit is running at −20° F. and the vapor motor is not as efficient as it is at +35° F.

The Defrost mode is used when frost and ice has built up on the evaporator coil reducing the efficiency and performance of the unit. This mode can only be entered on demand and with user intervention. Once started, Defrost mode continues until a timer signals completion, the evaporator temperatures reach a preset value, or the door to the cooled space is open.

When none of the protective algorithms are operating, the SMP selects one of the five primary states, namely Heat, Cool, Defrost, Null, or Quench. Quench mode can only be selected following a Heat mode or a Defrost mode and is intended to prevent overheating of the heater and the evaporator coil. As such, it is not a true active control mode.

Heat, Cool, and Defrost are all active control states in that the PID controller is maintaining the speed of the fan motor at a desired set point. The set point is a function of the specific mode entered and is adjustable by the user. For example, in the preferred embodiment, if the Heat mode is selected, the PID controller will attempt to maintain the fan speed at 850 RPM. If the Cool mode is selected, two different speeds are possible, 1600 RPM, or 1200 RPM. The slower speed is used when conservation of cryogen is critical or noise abatement is required.

The Null mode is the mode in which the system spends a majority of time. In this mode the system temperatures are monitored and the system is maintained in a ready state in anticipation of returning to one of the active control modes of Heat, Cool, or Defrost.

The present system uses the SMP to determine which mode to operate in rather than a complex fuzzy logic scheme. This allows for the use of simpler processors, programs, and systems while still achieving the same level of control. The SMP uses inputs such as the cooled space temperature, ambient air temperature and desired temperature set points to determine which active control mode (Heat, Cool, Null, Quench, or Defrost) the system should be operating in. The SMP will also evaluate the input conditions to determine if the active mode should be overridden by ambient lockouts, Top Freeze Protection, Superheat Protection, or the $CO_2$ Saver. If an override is warranted, the active control mode will not be initiated or will be discontinued, and the overriding algorithm will control the system operation. If no override is present, the system will enter one of the active control modes and control the fan speed at the desired set point value for that given mode. If no heating or cooling is necessary, the system will enter Null mode. While only a few modes are discussed, it is contemplated that the SMP could be utilized with additional modes not discussed and therefore should not be limited to only those modes. In addition, the override modes described are not the only overrides the SMP is capable of evaluating, others could be added as necessary for the given cryogen refrigeration system.

BRIEF DESCRIPTION OF THE DRAWINGS

In the drawings:

FIG. 2 shows a state diagram of the temperature control system of FIG. 1;

FIG. 7 lists an ECOP pressure conversion table and a ECOP temperature conversion table used in a temperature control system according to the present invention.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
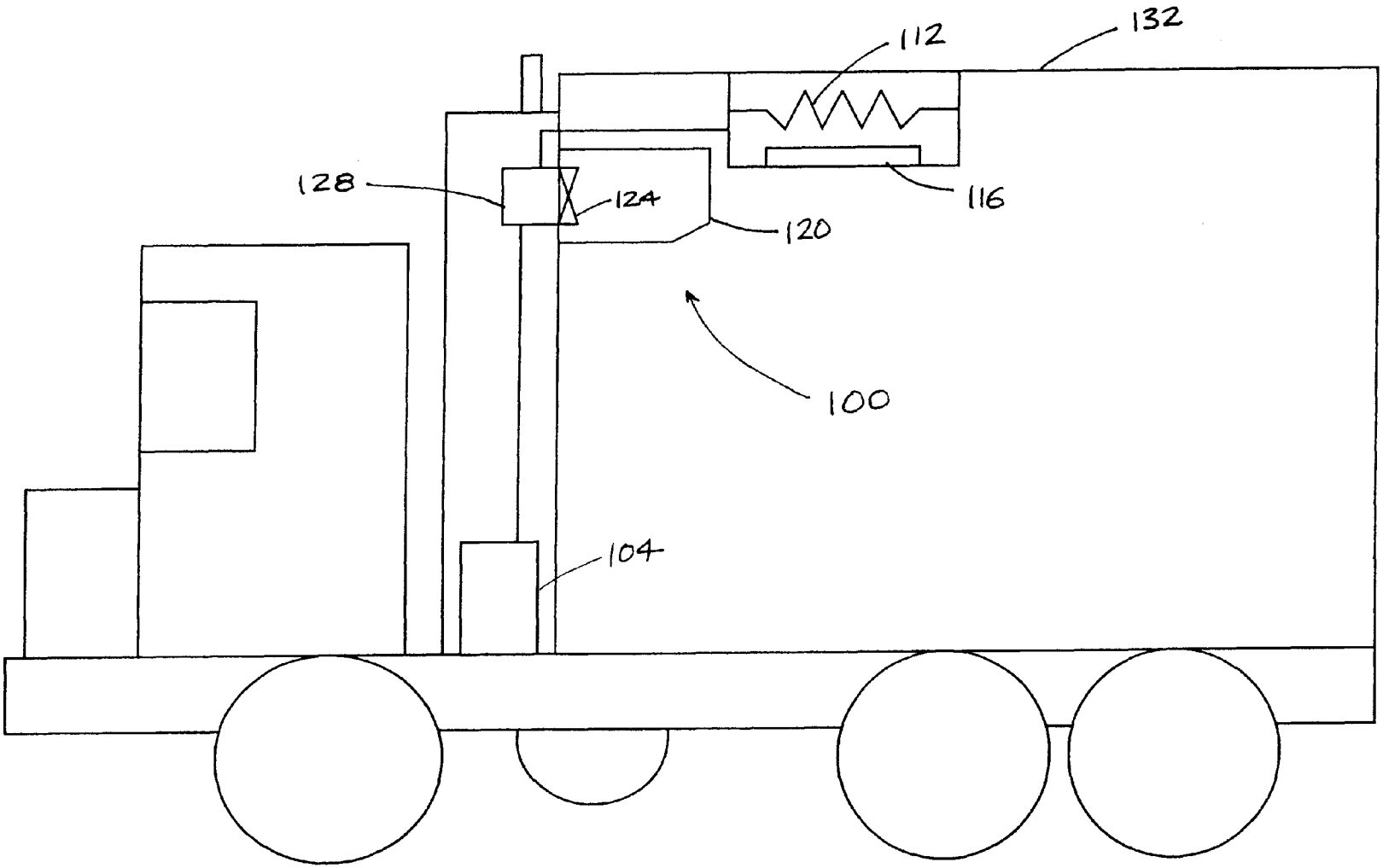
FIG. 1 illustrates a truck/trailer unit with a temperature control system according to the present invention.

FIG. 1 shows a truck/trailer unit in which a temperature control system 100 according to the present invention is implemented. The control system 100 includes a PID controller 104, a heat source 116, a second heat exchanger 120, and a heat exchanger fan 124 driven by a vapor motor 128. The PID controller 104 is operatively coupled to a liquid cryogen tank 108 which provides a cryogenic liquid to a heat exchanger or an evaporator 112. The controller 104 is designed to control the atmospheric temperature within a trailer 132. The PID controller 104 controls the temperature inside the trailer 132 via a plurality of override functions, including superheat protection, top freeze protection, ambient lockouts, and $CO_2$ saver, which is detailed hereinafter.

The primary temperature control algorithm utilized by the controller 104 is a Mealy type finite state machine 150 as shown in FIG. 2. In a mealy state machine, the current state and the current input affect the next state transition asynchronously. The controller 104 is designed to operate even with failed or malfunctioning sensors provided a backup scenario exists. The operations shown in FIG. 2 are explained hereinafter.

The core of the temperature control system 100 is the state machine 150, which includes a combination of logic to move from and into the modes including "Heat," "Defrost," "Cool," "Null," and "Quench." Each of these modes except the Null mode uses a PID control method to control the RPM of the fan 124 of the control system 100. The controller 104 has a plurality of protection algorithms including ambient lockouts, top freeze protection, superheat protection, and Carbon Dioxide ("$CO_2$") saver.

In the preferred embodiment, a startup routine (not shown) is generally responsible for making sure the system 100 is safe to begin operation and provides initial output control until the controller 104 comes online. The system 100 startup is initiated whenever a system switch is flipped to the on/run position or the system 100 is going from a Null mode to an active mode of operation including a Heat mode and a Cool mode. The startup routine is detailed is as follows: An expansion valve ("EXV") is closed or zeroed at power on, followed by setting the EXV to open to a predetermined percentage, preferably 15%, at power on. A defrost shutter is subsequently opened if the system 100 is not entering the Defrost mode. If the system 100 is starting from a Null mode to a Heat mode or a Null mode to a Defrost mode, then the heater fan output is turned on for a predetermined amount of time, preferably for 15 seconds, before moving to the next procedure, and the heater fan will remain on for the duration of the Heat mode or the Defrost mode. However, if the heater fan does not start, some alarm codes indicating a heater fan failure and a restart null are normally set in, and the startup sequence is halted.

Afterwards, a motor vane valve ("MVV") is turned on and a first timer is started, while the Cool solenoids are also turned on with a second timer. The system 100 waits for an RPM to be greater than a predetermined speed, preferably 0, or the first timer to expire. In either case, the MVV is turned off. After the second timer has expired, if the RPM is not greater than the predetermined speed, and an evaporator coil outlet pressure ("ECOP") is not greater than a predetermined pressure (for example, 60 psi), other alarm codes indicating a no start shutdown condition and a restart null are normally set in. The startup sequence finishes and moves to the controller when the RPM is greater than the predetermined speed and the ECOP is greater than the predetermined pressure. If the ECOP sensor has failed, the system 100 will start when the RPM is greater than the predetermined speed alone. When the system 100 enters Null, the EXV is preset to open to decrease the startup time. Anytime the system 100 goes into a shutdown or prevent shutdown mode, the EXV is also preset to open to the predetermined percentage to prevent an unexpected fill mode from causing the RPM to spin out of control.

Figure 3:
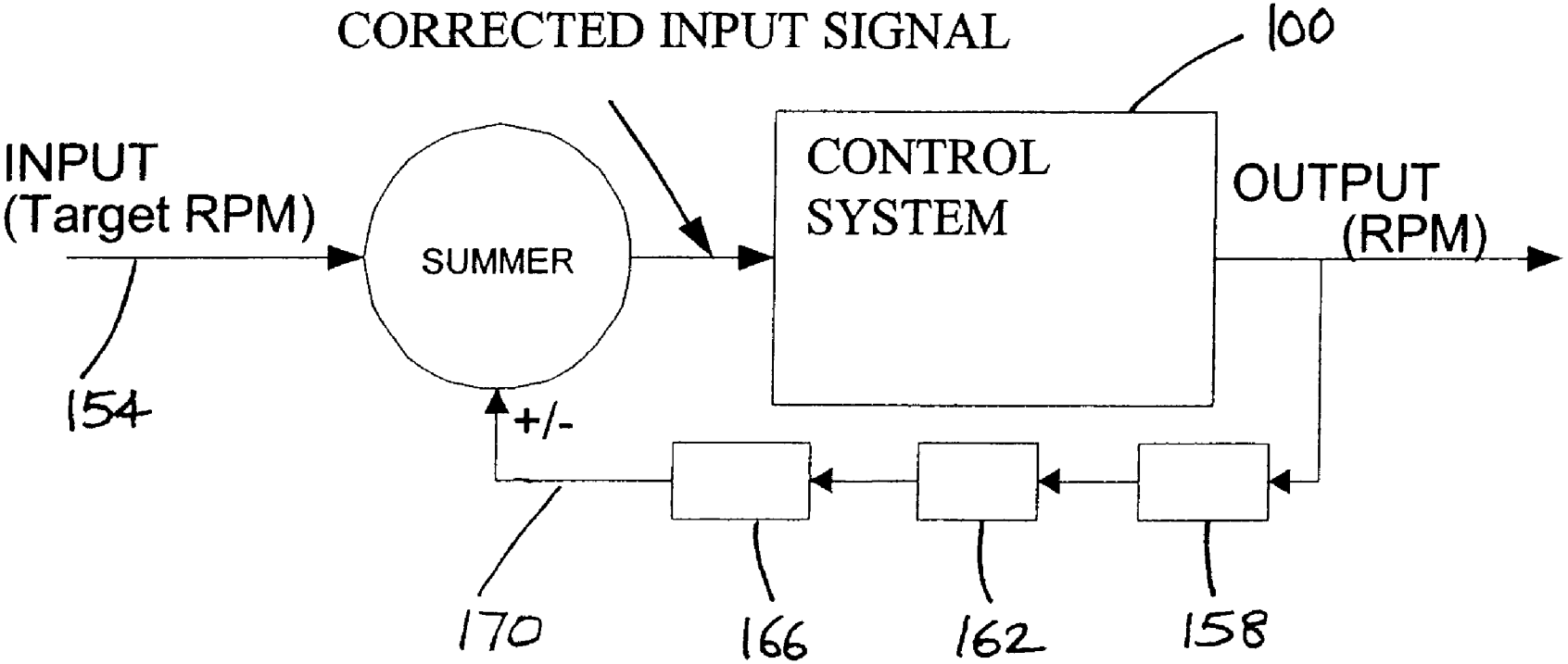
FIG. 3 shows a PID control system as utilized in the temperature control system of FIG. 1.
Figure 4:
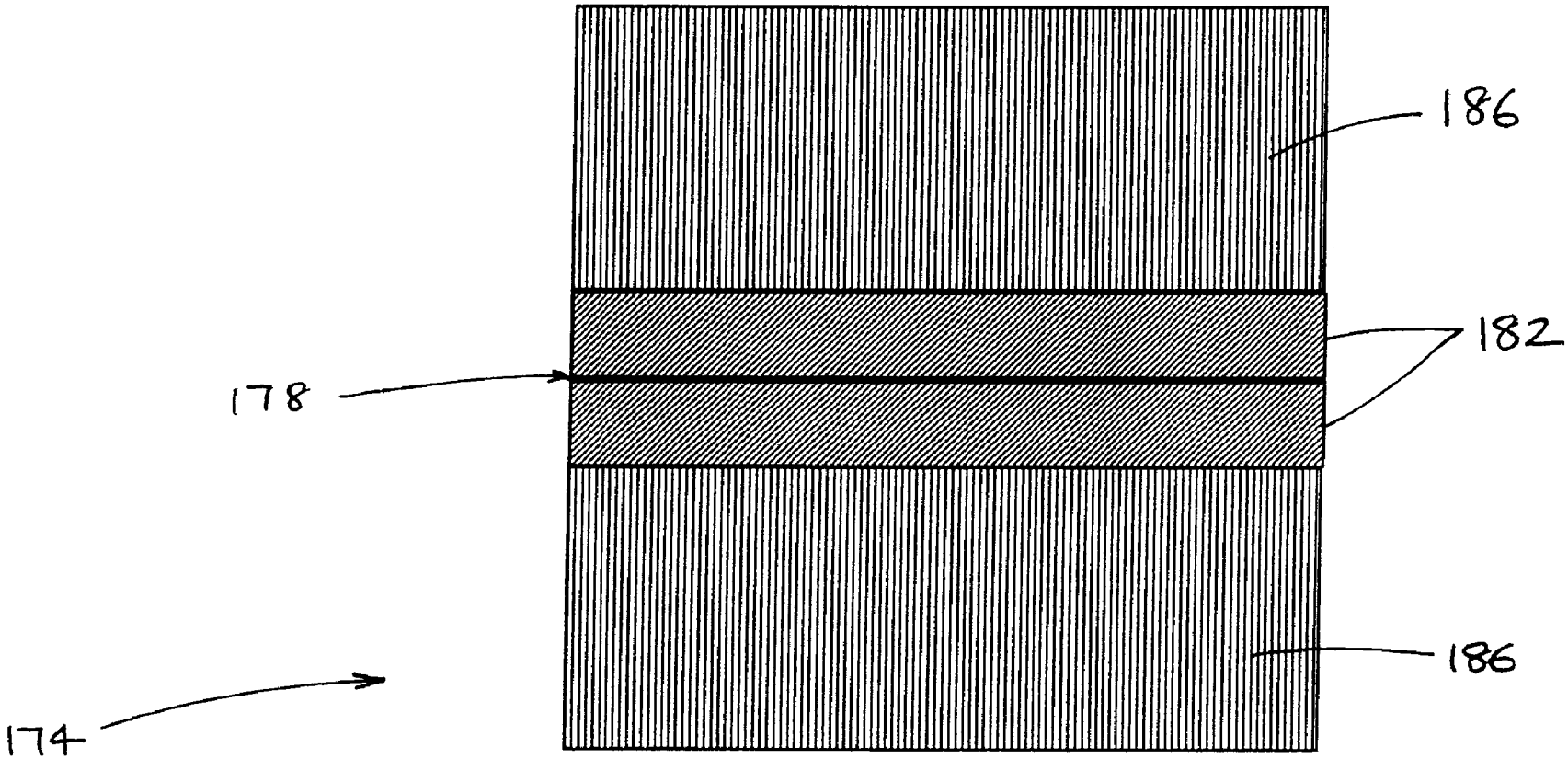
FIG. 4 illustrates a proportional speed band model used in the temperature control system of FIG. 1.

Referring to FIG. 3, the controller 104 uses error signals such as a proportional error ("PE"), a derivative error ("DE"), and an integral error ("IE"), to modify an input signal such as a target RPM 154. In a preferred embodiment, both the proportional error and the derivative error are limited to a proportional band ("PB"), as shown in FIG. 4, for a particular mode of operation (±800 RPM for the Cool mode and ±850 RPM for the Heat mode). The integral error is allowed to accumulate to the PB*$K_I$ where $K_I$ is a constant relating to the IE, allowing the IE to be a dominant value once the system 100 is in steady state, and preventing a "slamming" of the IE when the system 100 is starting. Slamming occurs when the limit value is too small and a small change in the system 100 causes the error value to swing very quickly to its minimum or maximum value. Finally, once the error values have been added together, the sum is limited between zero and the +PB for the particular mode of operation. In a preferred embodiment, a zero represents a minimum EXV opening and +PB represents the maximum opening.

Furthermore, the proportional error ("PE") is determined in block 158 by subtracting the actual RPM reading from a set point RPM. The integral error ("IE") is the total area under (or over) a proportional error curve centered on the set point, and is determined in block 162. The integral error is preferably accumulated over approximately an entire running period of the system. (In a digital system, the integral error is calculated by summing the proportional error taken at each sampling period.) The derivative error ("DE") is generally a rate of change in the output RPM or the slope of the output RPM. The DE is preferably calculated in block 166 by subtracting the last RPM reading from the current RPM reading. The DE value is preferably re-calculated every sampling period. Once all of the errors have been calculated they are added together to give a total system error or TE 170. Note that the K values in blocks 158, 162, and 166 are gains (or attenuation) used to "weight" each error value. These weightings determine the reaction speed of the system 100 to certain types of error. For example, a large $K_d$ would mean the system 100 would react quickly to sudden changes in the output value. On the other hand, a large $K_i$ would correct large offsets in the output value quickly. However, making the constant gains too large will cause the system to fluctuate and become unstable, because the system 100 will be trying to overcorrect the problem.

A proportional band diagram 174 of the controller 104 is shown in FIG. 4. When the system 100 is operating in the Cool mode, a phenomenon known as "flashing" causes the liquid $CO_2$ to boil at different levels in the evaporator coil 112, thereby causing the RPM to fluctuate even when the EXV value is stable. To prevent the controller 104 from over compensating when the system 100 is close to a RPM set point 178, a deprived integral band 182 is used. When the RPM reaches the deprived integral band region 182, the integral error accumulates at half of its normal value thereby slowing the reaction of the PID controller 104 when the RPM is ±75 RPM from the set point 178. Additionally, there is a special band known as a RPM cutoff threshold (not shown) in the High Speed Cool mode of operation. If the RPM goes above the cutoff threshold value, the EXV is closed to about one percent open. The cutoff threshold provides an emergency override that prevents the RPM from spinning out of control and damaging the system 100.

FIG. 4 also shows an example of a proportional band 186. The proportional band 186 represents a normal operating region of the PID input signal. If the signal goes outside of the proportional band 186, the PID control is overridden and the EXV is set to a maximum (off the low end) or minimum (off the high end) value to bring the system 100 within normal operating parameters. If the controller 104 still fails to bring the system 100 within normal operating parameters, an appropriate alarm is set and the system 100 will be shut down.

In the Cool mode of preferred embodiment, the target RPM is preferably 1600 for high speed cooling or preferably 1200 for economy cooling. The deprived integral band is preferably set at ±75 RPM off the target RPM. The proportional band is preferably set at ±800 RPM off the target RPM, and the RPM cutoff value is preferably between ±550 RPM off the target RPM. In the Heat, Defrost, and Quench mode, the target RPM is preferably 850 while the deprived integral band is preferably set at ±0 RPM off the target RPM. The proportional band is preferably set at ±850 RPM off the target RPM, and there is preferably no RPM cutoff value.

Figure 5:
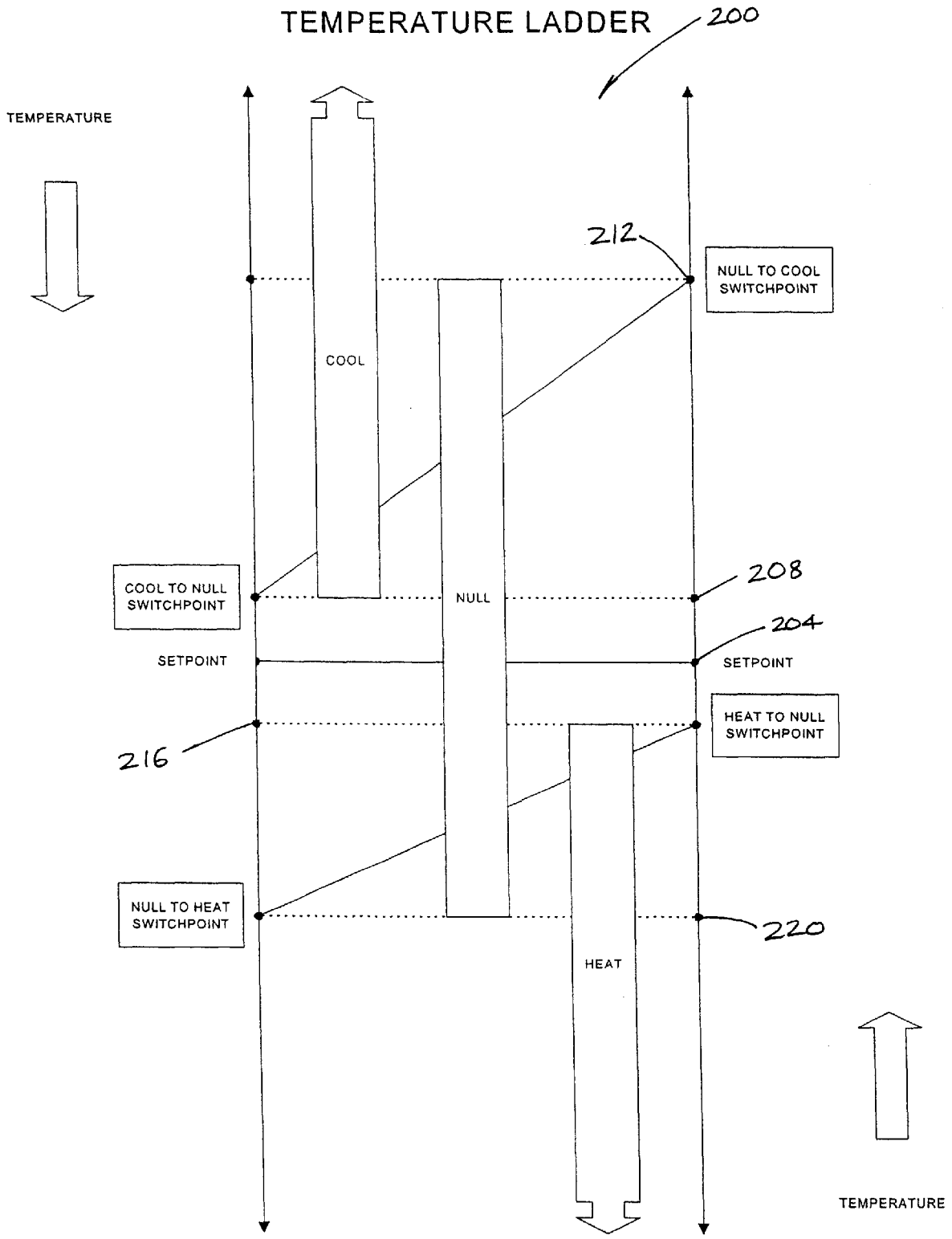
FIG. 5 shows a temperature ladder implemented in the temperature control system of FIG. 1.

FIG. 5 shows a temperature ladder 200 used in the temperature control system 100 according to the present invention. The temperature ladder 200 is a graphical representation of numerical switch points that dictate what mode the system 100 should be operating in (assuming no override such as ambient lockout, which will be detailed hereinafter, is active). The ladder 200 as shown in FIG. 5 uses the preferred values for all switch points. Note also that the left side of the graph is for falling temperatures, while the right side of the graph is for rising temperatures only. The temperatures listed are referenced from a return air temperature ("RA"), or a remote return air temperature ("RRA") if the RA sensor has failed or malfunctions, and the set point temperature.

Specifically, the temperature ladder 200 has a plurality of temperature switch points, including a set point temperature 204, a Cool to Null switch point 208, and Null to Cool switch point 212. While all temperature points on the ladder 200 are not absolute but are offsets from the set point 204, the switch point temperatures are generally adjustable. For example, the Null to Cool switch point 212 is preferably default at approximately 5.04° F. above the set point 204, but it also has an adjustable range through a guarded access (not shown) ranging from 10° F. to 1.8° F. The Cool to Null switch point 208 is preferably set at 0.9° F. above the set point 204. The temperature ladder 200 also includes a Heat to Null switch point 216 preferably set at −0.9° F. below the set point 204. A Null to Heat switch point 220 is preferably set at −3.42° F. below the set point 204 with an adjustable range from −10° F. to −1.8° F.

An ambient lockout is used to conserve $CO_2$. There are two types of ambient lockouts, an ambient Heat lockout and an ambient Cool lockout. The Heat lockout prevents the system 100 from running the Heat mode control when the return air ("RA") temperature is below a Null to Heat switch point ("NTH") 220 and an ambient air temperature ("AA") is greater than the pre-configured lockout temperature (set point temperature+offset temperature). The ambient Cool lockout is the opposite of the ambient Heat lockout. The ambient Cool lockout prevents the system from entering the Cool mode control when the RA is greater than the Null to Cool switch point ("NTC") 212 and the AA is less than the pre-configured lockout temperature (set point temperature+offset temperature). These lockouts are preferably active only when the system 100 is in the Null mode. There is no timeout for the ambient lockouts. As long as the ambient lockout condition is true, the system 100 will preferably not enter an active temperature controlling mode regardless of continued temperature rise or minimal temperature change from the AA effects on the container 132.

If the Cool and Heat lockout temperatures are separately adjustable from 0° F. to ±50° F. through a guarded access with a default temperature offset of approximately +10° F. degrees for Heat and −10° F. degrees for Cool, the ambient lockout operations are illustrated in the following examples. Example 1: the system 100 is in the Null mode with a set point 204 of 35° F. The AA is 80° F., and the RA is 20° F. Under normal conditions the system 100 would go to active heating mode to bring up the RA temperature, but with ambient lockout, the system 100 will remain in the Null mode and let the AA pull up the temperature. Example 2: the system 100 is in the Null mode with a set point 204 of 35° F. The AA is −10° F., and the RA 50° F. Under normal conditions the system 100 would go to active cooling mode to pull down the RA temperature, but with ambient lockouts, the system 100 will remain in the Null mode and let the AA pull down the temperature. Example 3: the system 100 is in an active cooling mode with a set point of 35° F. and a RA of 40° F. When the system 100 entered Cool mode the AA was 30° F., but the system 100 went though a cold front and the AA drops to 10° F. Although the ambient Cool lockout conditions are now true, the system 100 will finish its current mode of operation and go the Null mode normally. If the condition remains true once the system 100 is in the Null mode, the system 100 will not enter Cool mode again as long as the condition remains true.

Another feature of the system 100 is the top freeze protection. Top freeze occurs during initial pull downs of a fresh load (a load 32° F. or above). When the system 100 is attempting to reach set point, a discharge air temperature ("DA") can fall below 32° F. for an extended period. The discharged cold air then falls onto the product, which over time will cause freezing on the load surface, which is undesirable. Top freeze protection prevents this by monitoring the DA when the set point is 32° F. or above. The monitoring is done by calculating the degree minutes accumulated in the system 100 as follows:

$$\text{degree minutes (dm)}\Big|_{0}^{251} = \sum_{t=0}^{\infty} \frac{\text{number of degrees F. (°F.) below 32° F.}}{\text{1 minute (60 seconds)}}$$

When the system 100 has accumulated approximately 250 degree minutes the EXV closes to 10% to allow the DA temperature to rise above 35° F. Once the DA is sufficiently warm, the degree minutes are cleared and the system 100 resumes normal control operation. The degree minutes are only calculated when the system 100 is in the Cool mode and the set point is in the fresh range (32° F. or greater). Whenever the system 100 enters another mode of operation, the degree minutes are cleared. The degree minutes are limited between zero and 251 degree minutes. If the DA sensor fails or goes out of range, an evaporator coil outlet temperature ("ECOT") sensor is used to calculate the degree minutes in the system 100.

Figure 6:
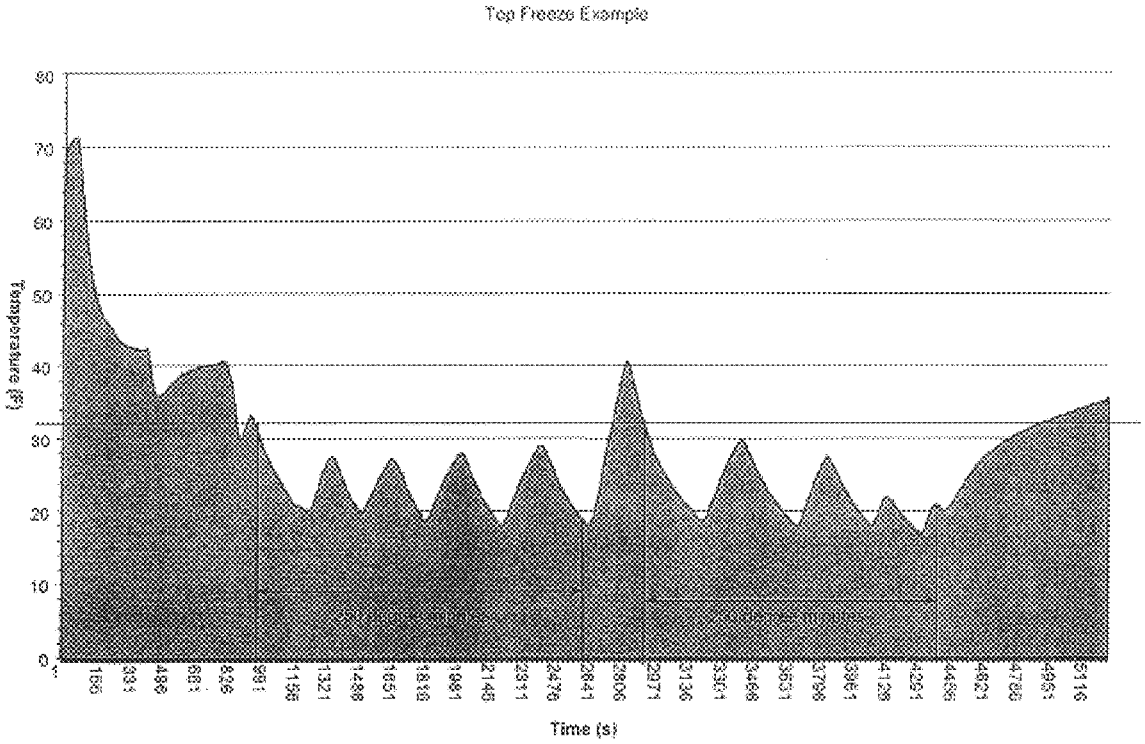
FIG. 6 shows a graphic example of a Top Freeze protection module of FIG. 1.

A graphical example of the Top Freeze protection is shown in FIG. 6. In the example, when the temperature first drops from a high of 72° F. to just below a set point temperature of 32° F. at time 870s, the top freeze degree minute starts to accumulate. The degree minute is cleared at time 920s once the temperature rises above the set point. However, as the temperature starts to drop again below the set point at time 991s, the top freeze degree minute starts to accumulate. Since the temperature does not go above the set point for 250 degree minutes, the system 100 enters the top freeze protection mode at 2641s, and the temperature rises thereafter. Once the temperature rises above the set point of 32° F. at time 2806s, the degree minute is cleared. The degree minute starts to accumulate again when the temperature falls below of 32° F. at time 2971s until 250 degree minutes have been accumulated at time 4400s. Thereafter, the system 100 again enters top freeze protection. Once the temperature rises above the set point of 32° F. at time 4950s, the degree minute is cleared, and the system 100 resumes normal operation.

Another overriding function is the super heat function. The super heat function checks the evaporator coil conditions on the system 100 to minimize the possibility of flooding the vapor motor 128 (of FIG. 1). Super heat is the temperature above the boiling point of any liquid. In the preferred embodiment, the liquid is $CO_2$. The super heat measurements indicate to the controller 104 if there is liquid near or at the vapor motor 128. The super heat entry switch point is 10° F. delta for both fresh and frozen loads. The super heat exit switch point is 32.5° F. When the system 100 enters superheat protection the EXV is closed by the offset value (preferably 10% or 80 steps), the system 100 then waits for 40 seconds and rechecks the super heat value. If the super heat value has not gone past the exit switch point, the EXV valve is closed an additional 10%. The superheat determination process is repeated until either the super heat value passes the exit switch point or the EXV is closed to a maximum of approximately 30% open (240 steps).

If the RA temperature is more than 30° F. from the set point, the system 100 assumes that as an initial pulldown, the super heat value is not determined for a predetermined amount of time of Cool operation, which is two minutes in the preferred embodiment. The temporary inactivity is necessary because the temperature sensors in the system, including the evaporator coil inlet temperature ("ECIT") and evaporator coil average temperature ("ECAT") sensors, have not yet reached their nominal operating temperatures. Using sensors which have not yet reached their operating temperature, causes a false super heat warning condition. In all other cases, the super heat determination preferably begins immediately.

The superheat is determined in one of three different ways depending on the operating status of the system 100. If the ECAT and the ECOP sensors function properly, the superheat is determined as follows:

$$\text{Superheat}=ECAT-ECOP \text{ saturation temperature } (T_{sat}),$$

where the ECOP saturation temperature ($T_{sat}$) is determined as follows:

$$T_{sat} \cong \frac{((ECOP - Pressure_{table})((Temp_{table+1}) - Temp_{table}))}{((Pressure_{table+1}) - ECOP)} + Temp_{table},$$

where $Pressure_{table}$ is the closest pressure entry in Table 224 as shown in FIG. 7 that is just above the current ECOP, $Pressure_{table+1}$ is the next pressure entry in Table 224 as shown in FIG. 7, $Temp_{table}$ is the corresponding temperature entry in Table 228 as shown in FIG. 7, and $Temp_{table+1}$ is the next temperature entry in Table 228 as shown in FIG. 7. Assuming the ECOP is 76.9 psi, an example of the saturated temperature calculation follows. Since ECOP is 76.9 psi, entry 2 of Table 224 contains a pressure that is just above 76.9 psi, and is 79.943 psi. As a result, the $Temp_{table+1}$ is contained in entry 3 of Table 224, and is −55° F. The $Temp_{table}$ is therefore −60° F. That is, $$T_{sar} = \frac{[(76.9\text{ psi} - 79.943\text{ psi})(^{-}55^\circ\text{ F.} - ^{-}60^\circ\text{ F.})]}{(91.2\text{ psi} - 76.9\text{ psi})} + ^{-}60^\circ\text{ C.} = ^{-}61.064^\circ\text{ F.}$$

If the ECOP sensor malfunctions or has failed, the system 100 then uses the following equation to determine the superheat value:

$$\text{superheat} = ECAT - ECIT.$$

If the evaporator coil inlet temperature ("ECIT") has failed, the system 100 determines the superheat value with the following equation:

$$\text{superheat} = ECAT - ^{-}60^\circ\text{ F.}$$

When the superheat has a drop of 10° F., the system 100 closes the EXV to approximately 10% minus the current EXV position to allow the $CO_2$ to boil off from the evaporator coil 112. For example, if the system 100 is running with an EXV position of 80% when the system 100 enters the superheat protection, the EXV will close to approximately 70% open. The superheat value is checked again after 40 seconds. If the superheat value has not passed the superheat exit switch point, the EXV will close an additional 10% to 60%. The superheat determination continues until the superheat value has passed the exit switch point or the EXV is closed to 30% open. (Note that if the ECAT temperature sensor fails, the superheat value is set to zero and the system 100 will automatically enter superheat protection.)

The system 100 exits the superheat protection immediately anytime the superheat value goes above 32.5° F. Once the system 100 exits the superheat protection, the target RPM for the system 100 is set to 1200 RPM even if the system 100 is configured for High Speed. This allows the controller 104 to control the system 100 and prevents the EXV from "slamming" open when exiting the superheat protection. Once the system 100 enters the Null mode, the next time the High Speed Cool begins, the target RPM will again be 1600 RPM. Note that the system 100 is still in the Cool mode while in any protection mode, including the super heat protection.

The purpose of a defrost mode is to warm up the evaporator coil 112 and to remove frost and ice from the system 100. The system 100 enters into the defrost mode from two different modes, Null and Cool. Particularly, there are four conditions to enter the defrost mode from the cool mode. Specifically, 1. A user requests manual defrost, the ECAT is less than or equal to a predetermined temperature, e.g. 45° F., the ECAT sensor functions properly, and the door is closed. This condition preferably exists for 10 seconds.
2. If the ECAT is less than or equal to a second predetermined temperature, e.g. −9.4° F., an evaporator coil outlet temperature ("ECOT") is less than the DA temperature, the ECAT, ECOT, and DA sensors function properly, and the door is closed. This condition preferably exists for 10 seconds.
3. If the ECOT is less than or equal to a third predetermined temperature, e.g. −50.0° F., the ECOT sensor functions properly, and the door is closed.
4. If the (DA−ECAT) value is greater than or equal to a fourth predetermined temperature, e.g. 40° F. for approximately 10 seconds, it has been at least 30 minutes since the last Defrost, the ECAT and DA sensors function properly, and the door is not open.

Similarly, there is a condition to enter the Defrost mode from the Null mode. This condition tests the following: the user requests manual defrost, the ECAT is less than or equal to a fifth predetermined temperature, e.g. 45° F., the ECAT sensor functions properly, and the door is closed.

The exit conditions for the Defrost mode are:

1. The door is open (overrides all other state transitions).
2. If the ECAT temperature is greater than or equal to a sixth predetermined temperature, e.g. 75.2° F., and the ECAT sensor functions properly.
3. If the ECOT is greater than or equal to a seventh predetermined temperature, e.g. 50.0° F., and the ECOT sensor functions properly.
4. The Defrost timer has timed out (30 or 45 minutes depending on a guarded access ("GA") entry).

The $CO_2$ saver functions as an optimizer to the control algorithm. The $CO_2$ saver maintains the maximum preferable RPM at the minimum EXV opening. The $CO_2$ saver is generally an iterative process. The iterative process modifies a target RPM setting of the controller 104 and allows the control algorithm to "naturally" control the RPM to a proper value. The iteration process is as follows.

1. The $CO_2$ saver does not start regulating the $CO_2$ or adjusting the $CO_2$ flow for a predetermined amount of time, e.g. two minutes in the preferred embodiment, after the system 100 has entered a temperature controlling state such as the Cool mode or the Heat mode. This allows the actual RPM to settle to a normal operating value.
2. If the actual average RPM over the predetermined amount of time is less than or equal to a predetermined speed, e.g. 15 RPM, below the current target RPM setting, the system 100 resets the target RPM to an another speed, e.g. 40 RPM, below the current actual average and lets the controller 104 control the RPM to the new target RPM setting.
3. The system 100 waits for a second predetermined amount of time, e.g. a minute, to assure that the actual RPM of the system 100 are stable. The system 100 then goes back to step 2. to repeat the procedure.

If at any time, for example when the system 100 is filled while the system 100 is running, the actual average RPM is approximately 50 RPM above the current target RPM setting for 30 seconds, the system 100 resets the target RPM setting to its original value and starts over. When the system 100 enters the Cool mode, the target RPM setting is 1600 (1200 for economy mode). When the system 100 enters a mode such as the Heat mode or the Defrost mode, the target RPM setting is 850 RPM. The RPM values are not reset when the system 100 enters a Quench mode. Also, note that if the system 100 enters superheat or top freeze protection, the RPM average is cleared and the system 100 waits for two minutes after the protection mode exits to re-determine the RPM average. When the $CO_2$ saver re-targets, the system 100 cuts a predetermined value from the IE stored in a lookup table thereby reducing the EXV position quickly by a small amount. This in turn allows the controller 104 to gain control of the new target RPM quickly and smoothly.

Referring back now to FIG. 2, the state diagram 150 according to the present invention shows five modes of operations including a Heat mode 232, a Quench mode 236, a Null mode 240, a Defrost mode 244, and a Cool mode 248. The Heat, Cool, and Defrost modes 232, 248, 244 are all active controlling states of the controller 104. In these states, the algorithm controls the RPM of the motor to a specific set point, and the specific state determines the RPM set point. In the Heat 232 and Defrost 244 modes, the set point is preferably set to, but not limited to, 850 RPM. In the Cool 248 mode, the preferred speed is 1600 RPM for regular Cool, and 1200 RPM for economy Cool. A state also determines the maximum and minimum EXV valve openings for the current mode of operation. In both Cool modes the minimum EXV opening is 4% and the maximum is 80%. All Heat modes operate with a minimum and maximum of 2% and 25% respectively. Finally, the current state sets the proper digital outputs for a given mode of operation.

Particularly, in the Heat mode 232, the controller 104 determines whether or not a door is opened at step 252. If the door is opened, the system 100 goes to the Quench mode 236 ("Y" path of step 252). If the door is not opened, the controller 104 checks to see if the RA and the RRA sensors function properly or not at step 256 ("N" path of step 252). If these sensors have failed, the system 100 will also go to the Quench mode 236 ("Y" path of step 256). If these sensors have not failed, the controller 104 continues to check to determine if the RA temperature is greater than the sum of the set point and the HTN temperatures at step 260 ("N" path of step 256). If the RA temperature is greater than the sum of the set point and the HTN temperatures, the system 100 will also go to the Quench mode 236 ("Y" path at step 260). Otherwise, that is, the RA temperature is less than or equal to the sum of the set point and the HTN temperatures, the controller 104 checks to determine if the ECIT temperature is greater than or equal to 375° F. at step 264 ("N" path at step 260). If the ECIT temperature is greater than or equal to 375° F., the system 100 also goes to the Quench mode 236 ("Y" path of step 264). Otherwise, the system 100 remains in the Heat mode 232 ("N" path of step 264).

Furthermore, in the Defrost mode 244, the controller 104 determines whether or not a door is opened at step 268. If the door is opened, the system 100 goes to the Quench mode 236 ("Y" path of step 268). If the door is not opened, the controller 104 checks to see if the RA and the RRA sensors function properly or not at step 272 ("N" path of step 268). If these sensors have failed, the system 100 will also go to the Quench mode 236 ("Y" path of step 272). If the sensors function properly, if either the ECAT temperature is greater than or equal to 75.2° F. or the ECOT temperature is greater than or equal to 50° F. (determined at step 276, "N" path of step 272), the system 100 goes the Quench mode 236 ("Y" path of step 276). If either the ECAT temperature is less than 75.2° F. and the ECOT temperature is less than 50° F., the system 100 checks to determine if the ECIT temperature is greater than or equal to 425° F. at step 280 ("N" path of step 276). If the ECIT temperature is greater than or equal to 425° F., the system 100 also goes to the Quench mode 236 ("Y" path of step 280). Otherwise, the system 100 remains in the Defrost mode 244 ("N" path of step 280).

Figure 8:
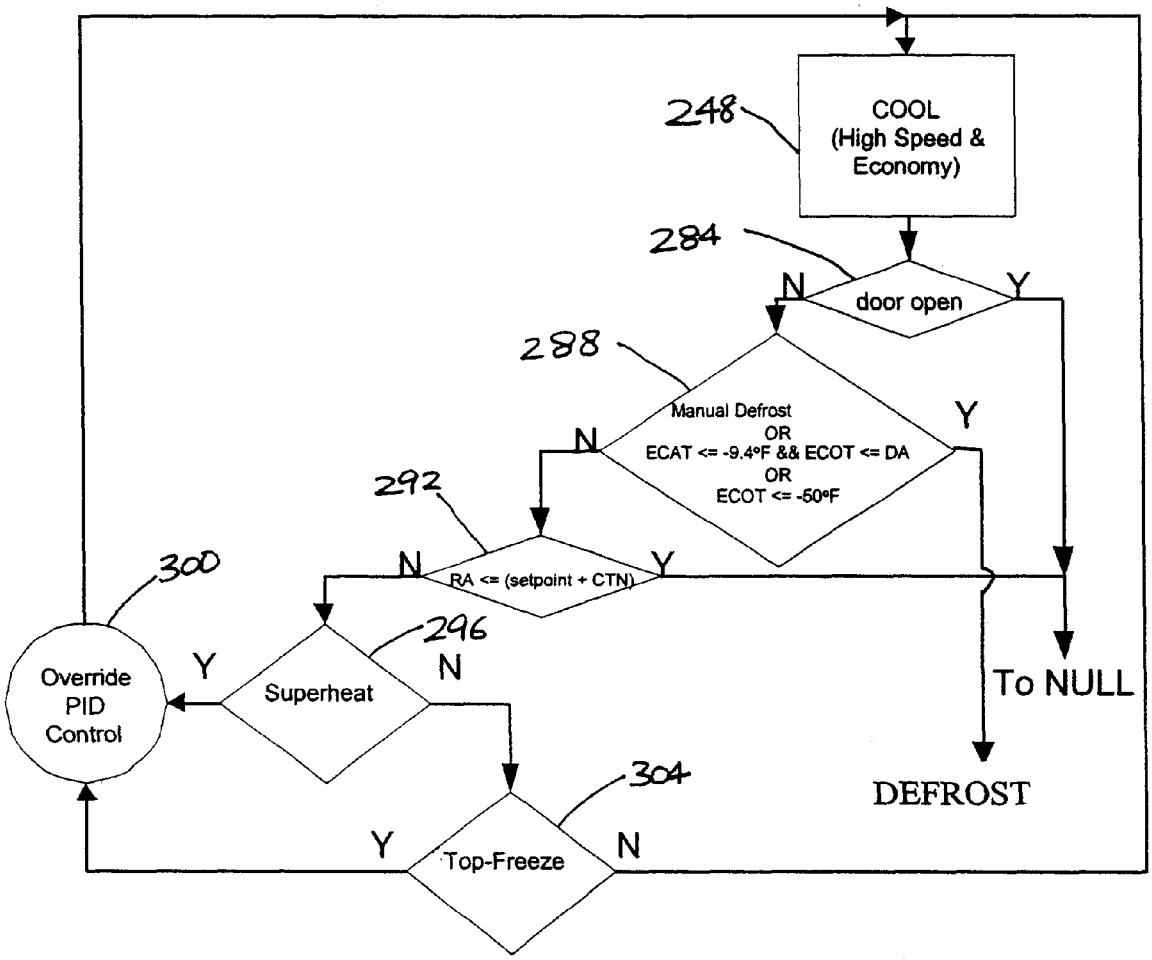
FIG. 8 shows a state diagram detailing the Cool mode operation as utilized in a temperature control system according to the present invention.

The Cool mode 248 also first checks if the door is opened at step 284. If the door is opened, the system 100 will go to the Null mode 240 ("Y" path of step 284). If the door is not opened, the controller 104 checks to determine if a manual defrost is requested, the ECAT temperature is greater than or equal to −9.4° F. and the ECOT temperature is less than or equal to the DA temperature, or the ECOT is less than or equal to −50° F. at step 288 ("N" path of step 284). If any of these conditions exists, the system 100 goes to the Defrost mode 244 ("Y" path of step 288). Otherwise, the system 100 checks the RA temperature at step 292 ("N" path of step 288). If the RA temperature is less than or equal to a sum of the set point temperature and the CTN temperature, the system 100 goes to the Null mode 240 ("Y" path of step 292). If the RA temperature is greater than the sum of the set point temperature and the CTN temperature, as more specifically shown in FIG. 8, the controller 104 checks for the Superheat condition at step 296 ("N" path of step 292). If the Superheat protection is needed, the PID controller 104 is overridden in step 300 ("Y" path of step 296) in a manner described earlier. Otherwise, the controller 104 checks for the Top Freeze condition at step 304 ("N" path of step 296). If Top Freeze protection is required, the PID controller 104 is overridden in step 300 ("Y" path of step 304) in a manner described earlier. If the Top Freeze protection is not required, the system 100 then remains at the Cool mode 248 ("N" path of step 304).

FIG. 2 also shows the operations in the Null mode 240. Specifically, most of the system time is spent in the Null mode 240. In the Null mode 240, the system 100 monitors the temperatures and maintains the readiness of the system 100 in anticipation of a system start for active temperature and RPM control. When the controller 104 determines that an active mode is needed, a start flag is set. The system 100 proceeds to pressurize the evaporator coil 112 and perform a pre-spinup on the vapor motor to engage the motor vanes. Once the system 100 has started successfully, the controller 104 in the Null mode 240 then sets the appropriate active mode including the Cool mode 248, the Heat mode 232, and the Defrost mode 244.

Specifically, the Null mode 240 first checks if the door is opened at step 308. If the door is opened, the system 100 will remains in the Null mode 240 ("Y" path of step 308). If the door is not opened, the controller 104 checks to determine if a manual defrost has been requested at step 312 ("N" path of step 308). If a manual defrost has been requested, the controller 104 goes to the Defrost mode 244 ("Y" path of step 312). If the manual defrost has not been requested, the system 100 checks the RA temperature at step 316 ("N" path of step 312). If the RA temperature is greater than the sum of a set point temperature and an NTC switch point, the controller 104 proceeds to check for the ambient Cool lockout condition at step 320 ("Y" path of step 316). If the system 100 is in ambient Cool lockout, then the system 100 remains in the Null mode 240 ("Y" path of step 320). If the system 100 is in not ambient Cool lockout, the system 100 goes to the Cool mode 248 ("N" path of step 320). If the RA temperature is less than or equal to the sum of a set point temperature and an NTC switch point, the controller 104 proceeds to check if the RA temperature is less than a sum of the set point temperature and the NTH switch point temperature at step 324 ("N" path of step 316). If the RA temperature is less than a sum of the set point temperature and the NTH switch point temperature, the controller 104 proceeds to check for the ambient Heat lockout condition at step 328 ("Y" path of step 324). If the system 100 is in ambient Heat lockout, then the system 100 remains in the Null mode 240 ("Y" path of step 328). Otherwise, the system 100 goes to the Heat mode 232 ("N" path of step 328). If the RA temperature is greater than or equal to the sum of the set point temperature and the NTH switch point temperature, the system 100 remains in the Null mode 240 ("N" path of step 324).

The Quench mode 236 is used as a temperature controlling method to prevent the heating element 116 on the system 100 from overheating. It is possible that the system 100 will never enter this state during active modes if the ECIT does not heat up enough. However, when the system 100 is exiting either the Heat mode 232 or the Defrost mode 244 (i.e. the system 100 is going to the Null mode 240), the Quench mode is called to cool the ECIT temperature approximately below 270° F. Thus, the Quench mode 236 is also referred to as a pseudo-mode. The system 100 can only enter the Quench mode 236 from the Heat mode 232 and the Defrost mode 244. Furthermore, the Quench mode is preferred to be active for less than approximately 60 seconds.

Specifically, if the Quench has not been active for 60 seconds (determined at step 328), the controller 104 checks to see if the door is opened and ECIT is less than or equal to 270° F. at step 332. If the door is opened and ECIT is less than or equal to 270° F., the system 100 goes to the Null mode 240 ("Y" path at step 332). Otherwise, the controller 104 checks if the previous mode is the Defrost mode, the defrosting is done, and ECIT is less than or equal to 270° F. at step 336 ("N" path at step 332). If the previous mode is the Defrost mode 244, the defrosting is done, and ECIT is less than or equal to 270° F., the system 100 goes to the Null mode 240 ("Y" path at step 336). Otherwise, it checks if the last mode is the Heat mode 232, RA is greater than the sum of the set point and the HTN switch point temperatures, and ECIT is less than or equal to 270° F. at step 340 ("N" path at step 336). If the last mode is the Heat mode 232, RA is greater than the sum of the set point and the HTN switch point temperatures, and ECIT is less than or equal to 270° F., the system 100 goes to the Null mode 240 ("Y" path at step 340). Otherwise, it checks to see if the last mode is the Heat mode 232, RA is less than the sum of the set point and the HTN switch point temperatures, and ECIT is less than or equal to 370° F. at step 344 ("N" path at step 340). If the last mode is the Heat mode 232, RA is less than the sum of the set point and the HTN switch point temperatures, and ECIT is less than or equal to 370° F., the systems 100 goes to the Heat mode 232 ("Y" path at step 344). Otherwise, it checks to see if the last mode is the Defrost mode 244, the defrosting is not done, and ECIT is less than or equal to 420° F. at step 348 ("N" path at step 344). If the last mode is the Defrost mode 244, the defrosting is not done, and ECIT is less than or equal to 420° F., the system 100 goes to the Defrost mode 244 ("Y" path at step 348). Otherwise, the system 100 remains in the Quench mode 236 ("N" path at step 348).

However, if the Quench has been active for 60 seconds, the controller 100 determines if the door is opened at step 352 ("Y" path at step 328). If the door is opened, the system 100 goes to the Null mode 240. Otherwise, it checks to determine if the ECIT sensor functions properly or not at step 356 ("N" path at step 352). If the ECIT sensor functions properly, the system 100 goes also to the Null mode 240. Otherwise, it checks to determine if the RA temperature is less than or equal to a sum of the set point and the HTN switch point temperatures, and the last mode is the Heat mode at step 360 ("N" path at step 356). If the RA temperature is less than or equal to the sum of the set point and the HTN switch point temperatures, and the last mode is the Heat mode, the system 100 again goes to the Null mode 240 ("Y" path at step 360). Otherwise, it checks to determine if the last mode is the Defrost mode, and the defrosting is not done at step 364 ("N" path at step 360). If the last mode is the Defrost mode, and the defrosting is not done, it goes to the Defrost mode 244 ("Y" path at step 364). Otherwise, the system 100 goes to the Null mode 240 ("N" path at step 364).

Various features and advantages of the invention are set forth in the following claims.

What is claimed is:

1. A method of temperature control in a cryogenic system comprising:

providing a motor speed sensor, the motor speed sensor being operatively coupled to a proportional-integral-derivative controller, the motor speed sensor determining a motor speed and sending the motor speed to the proportional-integral-derivative controller;

providing a pressure sensor, the pressure sensor being operatively coupled to the proportional-integral-derivative controller, the pressure sensor determining a cryogenic pressure, and sending the pressure to the proportional-integral-derivative controller;

providing a temperature sensor in the conditioned space, the temperature sensor being operatively coupled to the proportional-integral-derivative controller, the temperature sensor measuring a temperature within the conditioned space and sending the temperature to the proportional-integral-derivative controller;

providing a deprived integral region in a proportional band to the proportional-integral-derivative controller when the motor speed is close to a motor speed set point; and generating an overriding control signal at the proportional-integral-derivative controller when the temperature and the pressure are beyond a temperature set point and a pressure set point.

2. The method of claim 1, wherein the temperature is a return air temperature, and wherein with the system in a null mode, generating the control signal comprises:

determining an ambient temperature;

providing a switch point temperature;

providing a lockout temperature;

comparing the returned air temperature with the switch point temperature;

comparing the ambient temperature and the lockout temperature; and locking out a heat mode when the returned air temperature is less than the switch point and the ambient temperature is greater than the lockout temperature.

3. The method of claim 2, wherein the switch point temperature is a null-to-heat switch point temperature.

4. The method of claim 1, wherein the temperature is a return air temperature, and wherein with the system in a null mode, generating the control signal comprises:

determining an ambient temperature;

providing a switch point temperature;

providing a lockout temperature;

comparing the returned air temperature with the switch point temperature;

comparing the ambient temperature and the lockout temperature; and locking out a cool mode when the returned air temperature is greater than the switch point and the ambient temperature is less than the lockout temperature.

5. The method of claim 4, wherein the switch point temperature is a heat-to-cool switch point temperature.

6. The method of claim 1, wherein generating the control signal comprises generating a top freeze protection signal when the temperature has fallen below a predetermined temperature for a predetermined amount of degree minutes.

7. The method of claim 6, wherein the predetermined temperature is approximately 32° F., and the predetermined amount of degree minutes is approximately 250.

8. The method of claim 1, further comprising:

determining if the motor speed is within the deprived integral region; and accumulating an integral error at a rate that is half of an original rate.

9. The method of claim 1, wherein with the system in a high speed cool mode, the method further comprises:

providing a speed cutoff; and closing an expansion valve to approximately one percent when the speed is greater than the speed cutoff.

10. The method of claim 1, wherein the cryogenic pressure is determined at an end of an evaporator coil.

11. A method of controlling a cryogenic temperature system, wherein the cryogenic system uses a proportional-integral-derivative control, and controls the temperature within a conditioned space, the method comprising:

determining a motor speed;

determining a cryogenic pressure;

determining a plurality of temperatures inside the conditioned space;

determining a plurality of temperatures outside the conditioned space;

determining a new motor speed based on the motor speed, the pressure, the temperatures, and a plurality of predetermined temperature and pressure tables; and actuating the motor based on the new motor speed.

12. The method of claim 11, wherein the temperatures include a return air temperature and an ambient temperature, and wherein with the system in a null mode, the method further comprises:

providing a switch point temperature;

providing a lockout temperature;

comparing the returned air temperature with the switch point temperature;

comparing the ambient temperature and the lockout temperature; and locking out a heat mode when the returned air temperature is less than the switch point and the ambient temperature is greater than the lockout temperature.

13. The method of claim 12, wherein the switch point temperature is a null-to-heat switch point temperature.

14. The method of claim 11, wherein the temperatures include a return air temperature and an ambient temperature, and wherein with the system in a null mode, the method further comprises:

providing a switch point temperature;

providing a lockout temperature;

comparing the returned air temperature with the switch point temperature;

comparing the ambient temperature and the lockout temperature; and locking out a cool mode when the returned air temperature is greater than the switch point and the ambient temperature is less than the lockout temperature.

15. The method of claim 14, wherein the switch point temperature is a heat-to-cool switch point temperature.

16. The method of claim 11, further comprising generating a top freeze protection signal when the temperature has fallen below a predetermined temperature for a predetermined amount of degree minutes.

17. The method of claim 11, wherein the predetermined temperature is approximately 32° F., and the predetermined amount of degree minutes is approximately 250.

18. The method of claim 11, further comprising accumulating an integral error at a rate that is half of an original rate if the motor speed is within a deprived integral region.

19. The method of claim 11, wherein with the system in a high speed cool mode, the method further comprises:

providing a speed cutoff; and closing an expansion valve to approximately one percent when the speed is greater than the speed cutoff.

20. The method of claim 11, wherein the cryogenic pressure is determined at an end of an evaporator coil.

21. A method of conserving a heat absorbing liquid in a cryogenic temperature control system, wherein the system includes a controller and a motor, and wherein the controller adjusts a motor speed, the method comprising:

setting a target motor speed;

averaging the motor speed over a predetermined amount of time after the system has entered a temperature controlling mode;

regulating the heat absorbing liquid after the predetermined amount of time;

resetting the target motor speed to a new target motor speed if the average motor speed is less than or equal to a predetermined speed below the target motor speed, the new target motor speed being set below the average motor speed by a predetermined motor speed value; and adjusting the motor speed such that the motor speed approaches the new target motor speed for a second predetermined amount of time.

22. The method of claim 21, wherein resetting the target motor speed and adjusting the motor speed are repeated.

23. The method of claim 21, wherein the predetermined amount of time is approximately two minutes.

24. The method of claim 21, wherein the predetermined speed is approximately 15 RPM.

25. The method of claim 21, wherein the predetermined motor speed value is approximately 40.

26. A cryogenic temperature control system comprising:

a conditioned space containing a gas and a load, the gas having a gas heat and thereby also having a temperature;

a heat exchanger in the conditioned space, the heat exchanger having a heat absorbing liquid, and the heat absorbing liquid absorbing the gas heat within the conditioned space thereby lowering the temperature within the conditioned space;

a heat source, the heat source releasing heat into the conditioned space thereby increasing the temperature within the conditioned space;

a fan adjacent to the heat source and the heat exchanger, the fan circulating the gas in the conditioned space thereby having a fan speed;

a first temperature sensor determining a first temperature within the conditioned space:

a second temperature sensor, measuring a second temperature outside the conditioned space;

a pressure sensor determining a cryogenic pressure; and a controller operatively coupled to the fan, the first and second temperature sensors, the pressure sensor, the heat exchanger, and the heat source, the controller receiving the first and second temperatures from the first and second temperature sensors, receiving the pressure from the pressure sensor, adjusting the fan speed within the proportional band based on the first and second temperatures, the pressure, and the fan speed.

27. The system of claim 26, further comprising a plurality of temperature pressure conversion tables, the tables converting a pressure into a translation temperature, and the translation temperature determining whether the system enters a super heat mode.

28. The system of claim 26, wherein the cryogenic pressure is determined at an end of the heat exchanger.

* * * * *